US005314078A

United States Patent [19]

Morikiyo et al.

[11] Patent Number: 5,314,078

[45] Date of Patent: May 24, 1994

[54] FIRST-IN FIRST-OUT ARTICLE STORAGE RACK APPARATUS

[75] Inventors: Akira Morikiyo, Tokorozawa; Toshio Kanbe, Hidaka; Shuichi Shinbo, Moroyama; Shigeru Yoshikawa, Tokorozawa; Yoshikazu Shimodaira, Abiko; Kazuya Ohminami, Hachioji; Hitoshi Komuro, Saitama, all of Japan

[73] Assignee: Tsubakimoto Chain Co., Osaka, Japan

[21] Appl. No.: 941,893

[22] Filed: Sep. 8, 1992

[30] Foreign Application Priority Data

Sep. 6, 1991 [JP] Japan ..... 3-079767

[51] Int. Cl.[5] ..... A47F 1/04

[52] U.S. Cl. ..... 211/59.2; 221/196; 221/266

[58] Field of Search ..... 211/59.2; 221/92, 130, 221/112, 195, 196, 266, 192

[56] References Cited

U.S. PATENT DOCUMENTS

| | | | |
|---|---|---|---|
| 951,323 | 3/1910 | Mathewson | 211/59.2 X |
| 1,424,904 | 8/1922 | Heindl | 211/59.2 X |
| 2,285,931 | 6/1942 | Kruckewitt et al. | 211/59.2 |
| 2,315,515 | 4/1943 | Gibson et al. | 211/59.2 X |
| 2,408,380 | 10/1946 | Dennis | 211/59.2 X |
| 2,442,025 | 5/1948 | Smith | 211/59.2 X |
| 2,496,304 | 2/1950 | Muffly | 211/59.2 X |
| 3,055,293 | 9/1962 | Lariccia | 211/59.2 X |
| 3,318,455 | 5/1967 | Takahashi | 211/59.2 |
| 4,109,984 | 8/1978 | Gandara | 211/59.2 X |
| 4,997,106 | 3/1991 | Rockola | 211/59.2 X |

FOREIGN PATENT DOCUMENTS 27446 of 1991 Japan .

*Primary Examiner*—David A. Scherbel
*Assistant Examiner*—Korie H. Chan
*Attorney, Agent, or Firm*—Howson and Howson

[57] ABSTRACT

An article storage rack apparatus for storing and dispensing articles in first-in, first-out order comprises side-by-side columns of slant racks, in which alternate slant racks in each column are inclined downwardly in opposite direction. Articles are introduced onto the topmost slant rack and slide downward by gravity to successively lower slant racks. The articles are transferred from a slant rack to the next lower slant rack by a transfer mechanism comprising tables which are movable vertically and tiltable. The articles are maintained in the same orientation as they slide down the array of slant racks. At the lower end of the bottom slant rack, the articles are dispensed, by a tilting table dispenser, in the same order in which they were introduced onto the top slant rack.

4 Claims, 9 Drawing Sheets

FIRST-IN FIRST-OUT ARTICLE STORAGE RACK APPARATUS

BRIEF SUMMARY OF THE INVENTION

This invention relates generally to article storage racks, and more particularly to an improved article storage rack apparatus for storing articles introduced from a high position onto plural stages of racks which are alternately inclined in opposite directions and for dispensing the articles from a low position successively in first-in, first-out order.

A typical article storage rack apparatus of the prior art is described in Japanese Patent Publication No. 27446/91. In the typical storage rack apparatus, articles are stored on inclined racks and are discharged by utilizing the inclination of the racks. The apparatus includes a traveling loader adapted to move along the racks for warehousing the articles, a lift base for moving the loader vertically and stopping it to introduce articles onto the racks, and a traveling dispenser for discharging the articles from the racks.

A problem with conventional article storage equipment incorporating such traveling loaders and dispensers and lift bases is their structural complexity.

The invention solves this problem by a first-in, first-out article storage rack apparatus comprising an article storage rack of vertically arranged slant racks which incline alternately in opposite directions, an article loading means for introducing articles onto the slant racks, a conveyance direction changing means for transferring articles, which have been fed to the lower end of a slant rack, onto the upper end of the slant rack immediately below, and an article delivery means for discharging the articles stored on the slant racks.

The article loading means introduces an article onto the high end of an upper slant rack whereupon the article slides down the slant rack by virtue of its own weight. It is received by the conveyance direction changing means which transfers the received article onto the high end of the next lower slant rack without changing the article's orientation relative to the slant racks. Consequently, an article which slides down the upper rack with one side facing frontward, slides down the next lower slant rack with the same side facing backward.

The article is then received by the next conveyance direction changing means, where it is transferred to the next lower slant rack and slides down that rack with the same side facing frontward.

In this way, the article slides down the slant racks successively in a zigzag path until it is received by the article delivery means, whereupon it stops and is stored. The article which has been loaded next, slides down the slant racks successively in the same manner until it comes into abutment with the preceding article, whereupon it stops and is stored. The delivery means therefore dispenses the articles in first-in, first-out order.

Further objects, details and advantages of the article storage rack in accordance with the invention will be apparent from the following detailed description when read in conjunction with the drawings.

DETAILED DESCRIPTION

Figure 1:
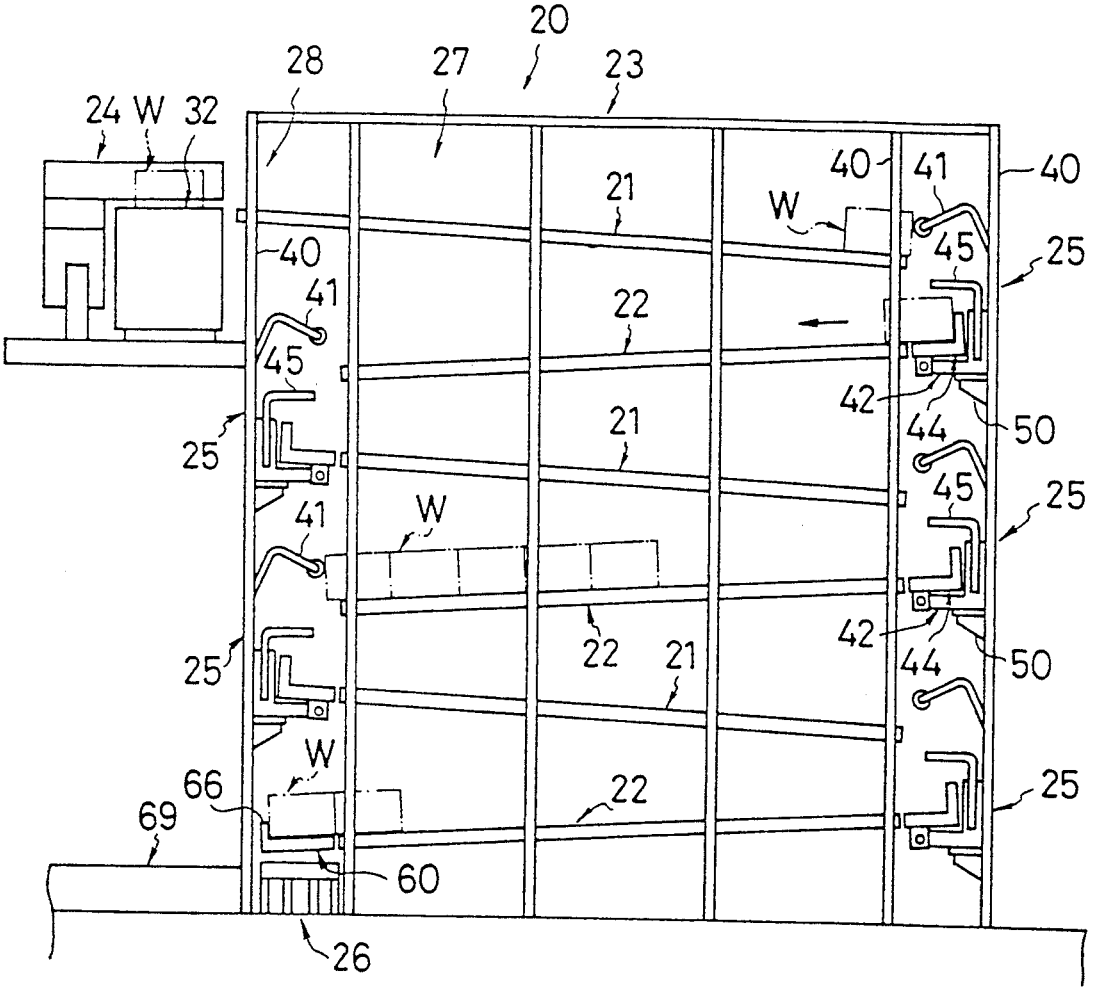
FIG. 1 is a schematic front elevation of an article storage rack apparatus according to the invention.
Figure 2:
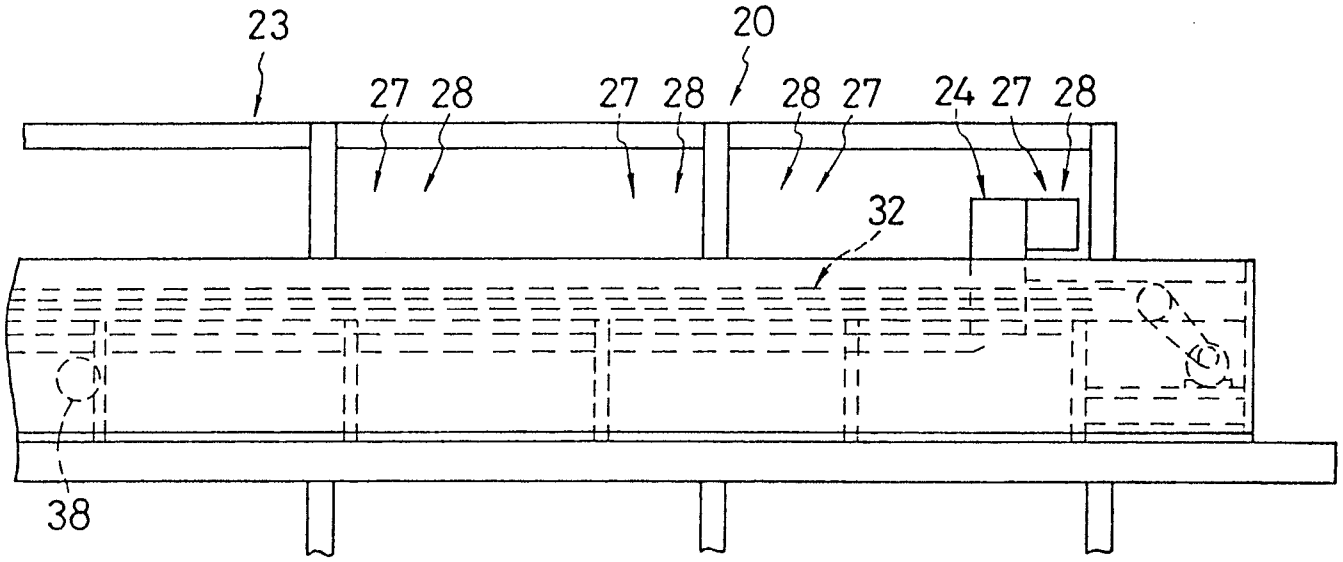
FIG. 2 is a elevational view of an upper portion of the article storage rack apparatus taken from the left side in FIG. 1.
Figure 7:
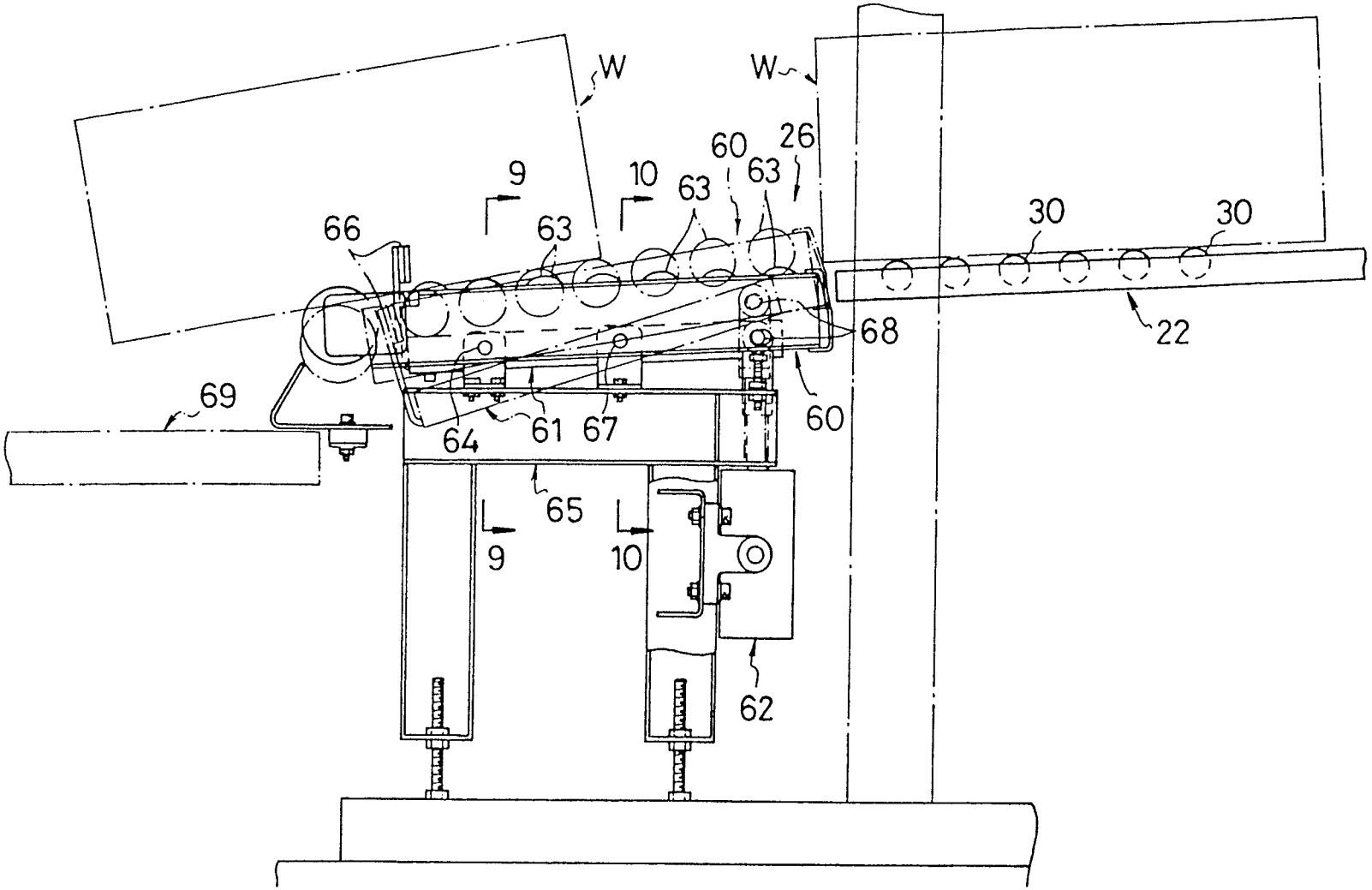
FIG. 7 is a front elevation view of a portion of the apparatus of FIG. 1 including an article delivery means.
Figure 8:
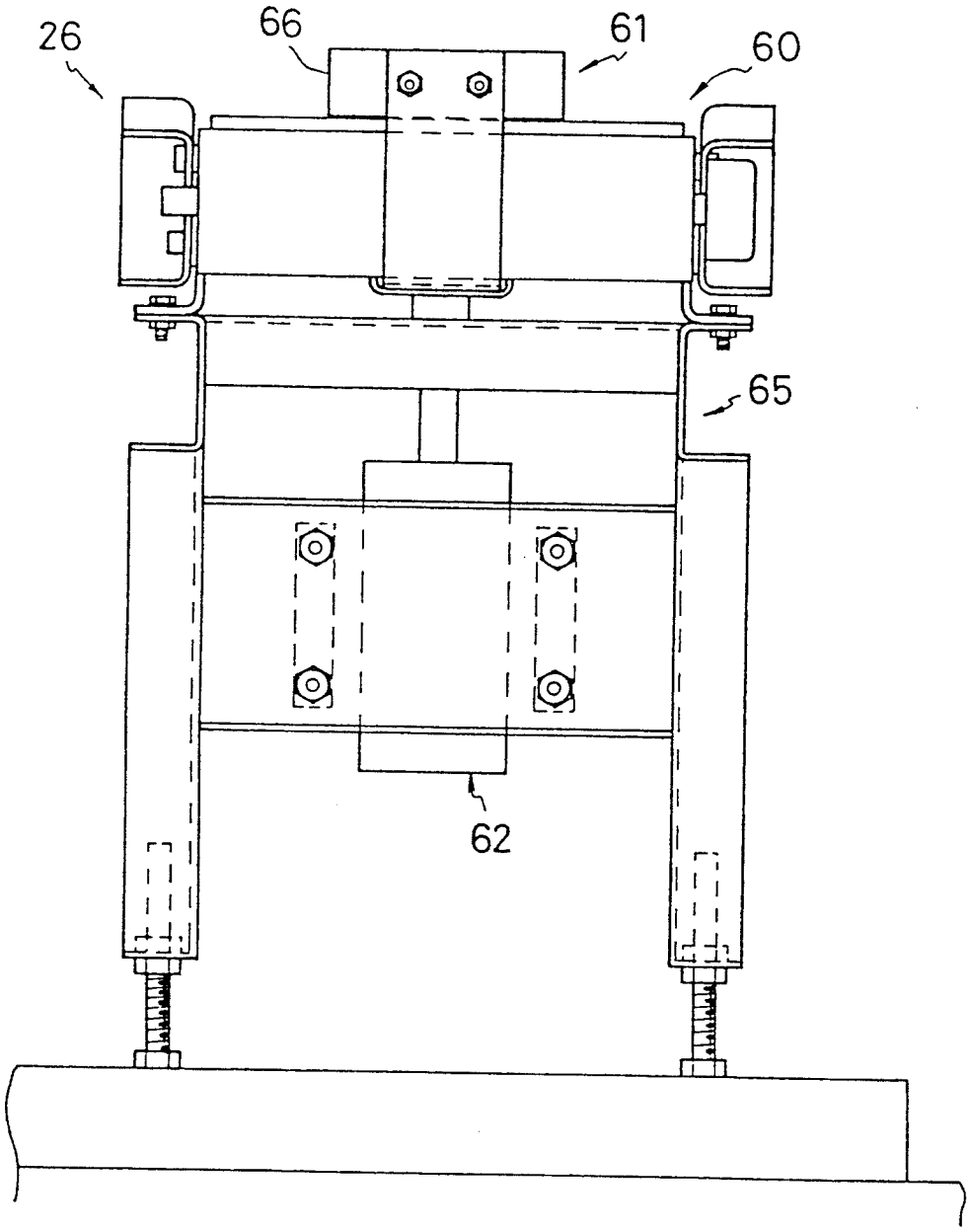
FIG. 8 is an elevation view of the article delivery means taken from the left side in FIG. 7.
Figure 9:
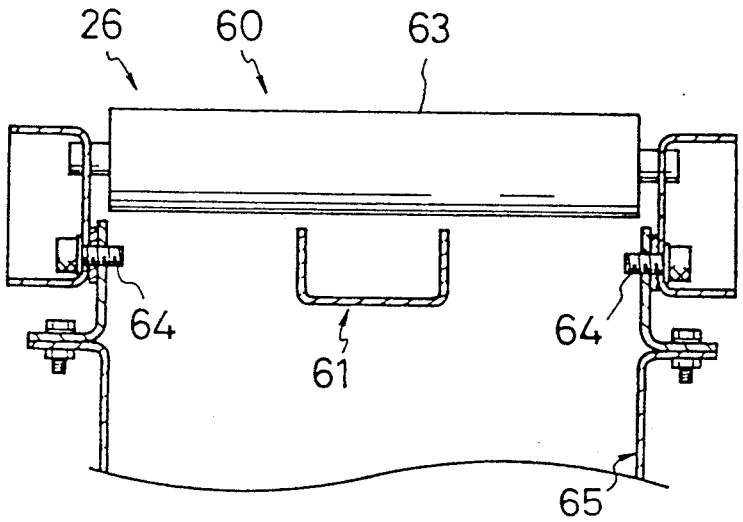
FIG. 9 is a sectional view in elevation of the article delivery means as seen through plane 9—9 in FIG. 7.
Figure 10:
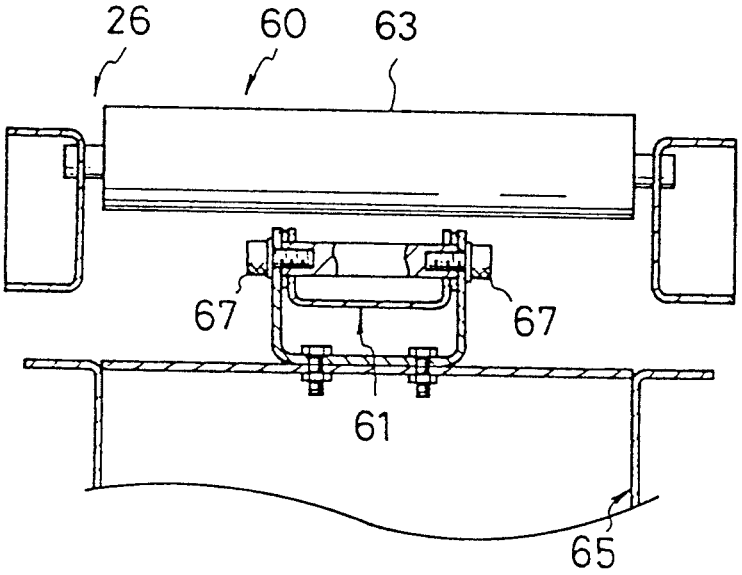
FIG. 10 is a sectional view in elevation of the article delivery means as seen through plane 10—10 in FIG. 7.

As shown in FIGS. 1 and 2, the article storage rack apparatus 20 comprises an article storage rack 23 which includes slant racks 21 inclined downwardly and to the right, and slant racks 22 inclined downwardly and to the left. In the storage rack apparatus 20, multiple arrays of slant racks 21 and 22 are arranged in side-by-side vertical columns to form a plurality of article storage areas 27 (FIG. 2). Only one such storage area 27 is seen in FIG. 1, as the storage areas are arranged side-by-side in a direction perpendicular to the plane of FIG. 1. Article loading means 24 is provided for loading articles W onto the topmost slant racks 21. Direction changing means 25 are provided for transferring articles W fed from an upper slant rack onto a next lower slant rack. Article delivery means 26 are provided for dispensing articles stored on the slant racks. Each of slant racks 21 and 22 is provided with a plurality of rollers 30 (FIGS. 3, 4 and 7), which allow articles W introduced by pusher 33 (FIG. 4) to slide or glide down the racks by virtue of their own weight.

As shown in FIG. 2, at the upper ends of the topmost slant racks 21, openings 28 serve as article inlets to article storage areas 27. A conveyor 32 transports articles W across article inlet openings 28.

One article loading means 24 serves all of the storage areas 27, but each storage area 27 is provided with its own set of direction changing means 25 and a delivery means 26.

Figure 3:
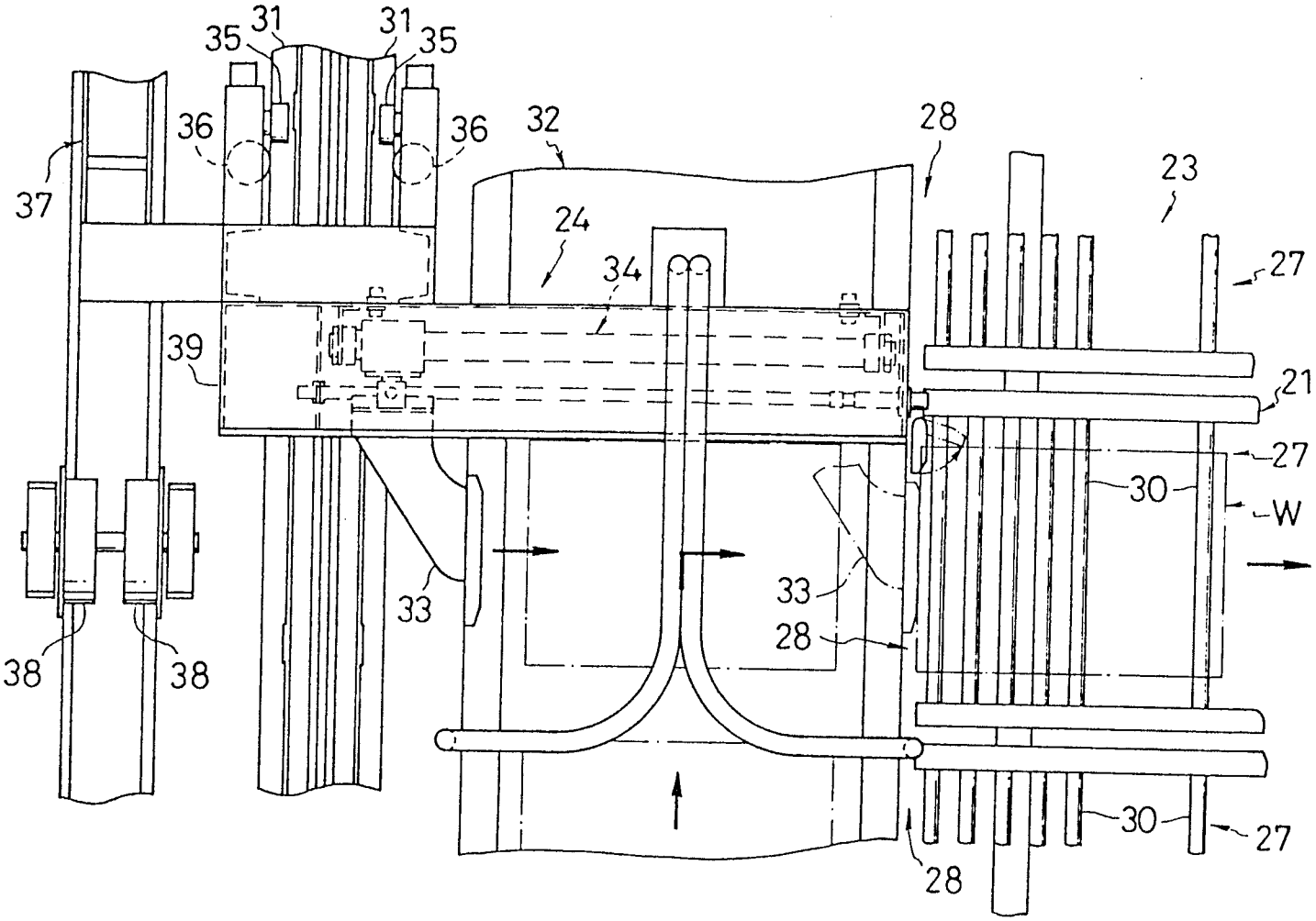
FIG. 3 is a top plan view of a portion of the apparatus of FIG. 1 including an article loadings means.
Figure 4:
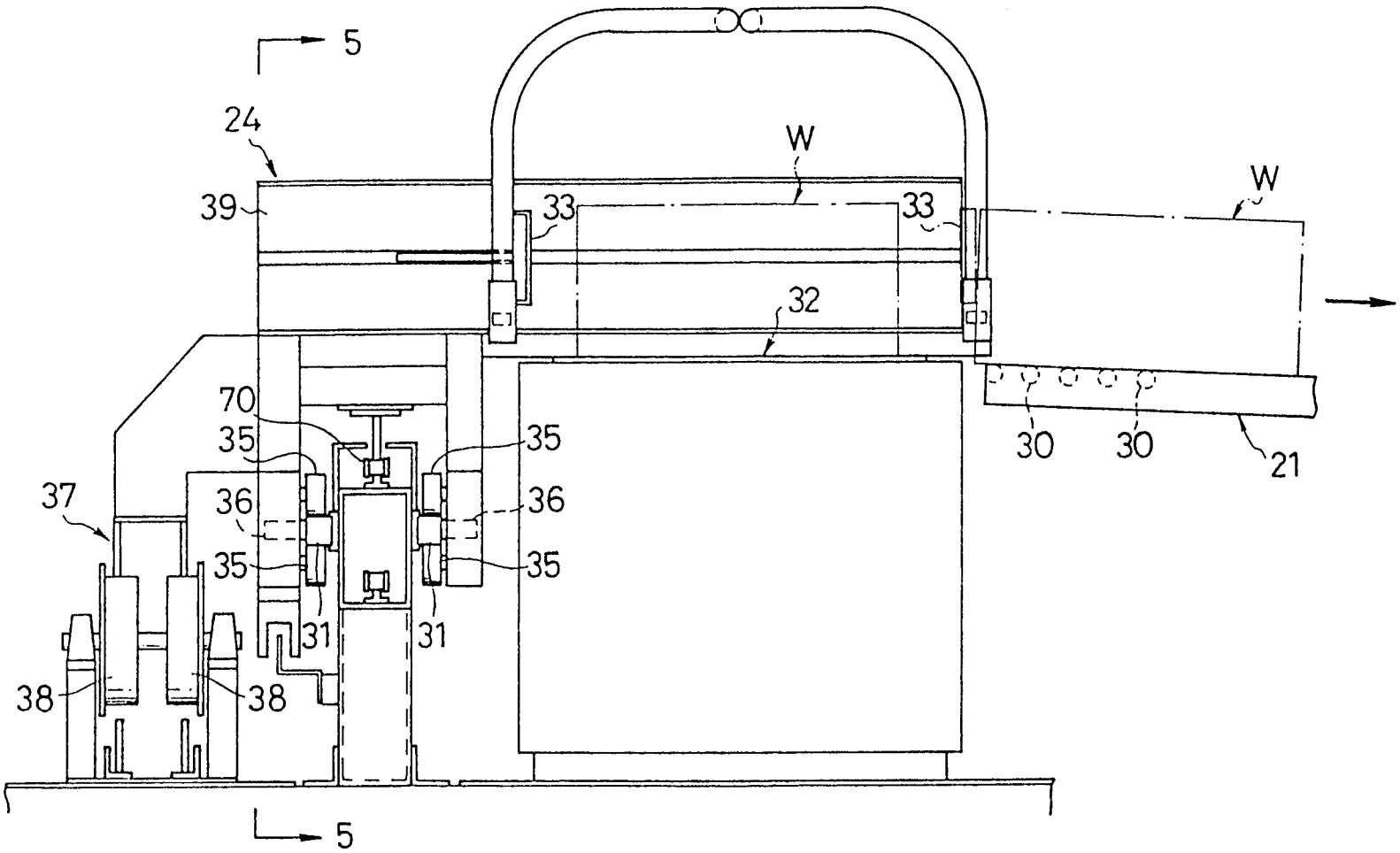
FIG. 4 is an elevation view of the article loading means taken from the left side in FIG. 3.
Figure 5:
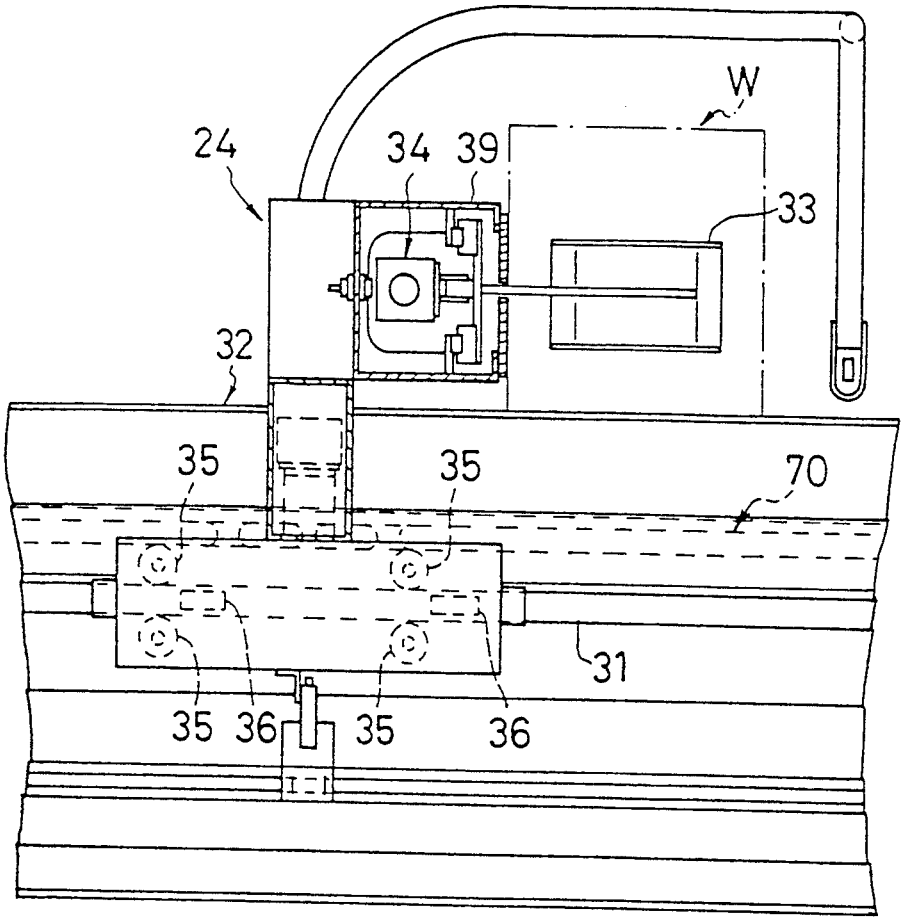
FIG. 5 is a sectional view in elevation of the article loading means as seen through plane 5—5 in FIG. 4.

Referring to FIGS. 3-5, the loading means 24 is movable, by traction chain 70, on rails 31 (which extend in the right and left direction in FIG. 2 and perpendicular to the surface of the paper in FIG. 1) across the inlet opening 28 of each storage area 27, and stops in front of a selected inlet opening 28 to introduce articles W through a frame 39 onto the upper end of a topmost slant rack 21. Loading means 24 includes a pusher 33 arranged to push the article W off conveyor 32 and through inlet opening 28, a cylinder 34 for operating pusher 33, traveling wheels 35 and side rollers 36. Cylinder 34 is a conventional rodless type having a moving body (not shown) attached to pusher 33, which is made to reciprocates within cylinder 34 by air pressure, magnetic force, wire, or other means.

Power and control signal cables, and other flexible conduits (not shown), connected to loading means 24, are protected by a conventional cable drag chain 37 disposed in a U-shaped path turned sideways. Disposed halfway along the moving path are rotatable rollers 38 supporting the cable drag chain 37. With movement of the loading means 24, the side of cable drag chain 37 connected to loading means 24 also moves lengthwise while bending.

Operation of the article loading means 24 is as follows. In response to a control signal, loading means 24 travels by traction from chain 70 and stops in front of an inlet portion 28 of a selected article storage area 27. Thereafter, frame 39 of loading means 24 receives and stops an article W which has been conveyed by the conveyor 32. The article W is then pushed forwardly by the pusher 33 through the article inlet opening 28 onto the topmost slant rack 21.

Figure 6:
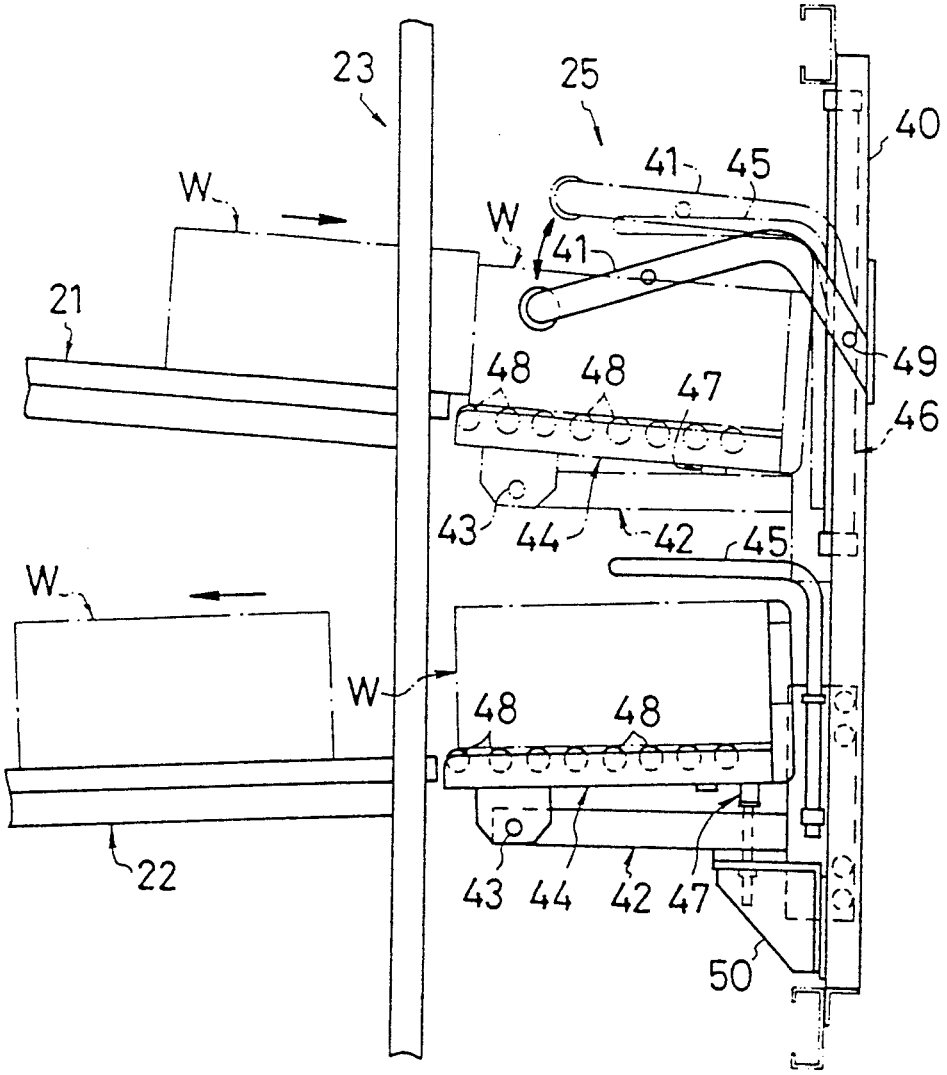
FIG. 6 is a front elevation of a portion of the apparatus of FIG. 1 including a conveyance direction changing means.

Referring now to FIG. 6, each conveyance direction changing means 25, disposed near both ends of slant racks 21 and 22 in storage areas 27, is provided with a tiltable stopper 41 pivotally connected by a pin 49 to a support post 40 of storage rack 23. A lift frame 42, movable vertically along support post 40, carries a tiltable table 44 pivotally connected by a pin 43 to lift frame 42. A tiltable stopper actuating piece 45 integral with lift frame 42 is formed to come into abutment with the tiltable stopper 41. A lift air cylinder 46 moves the lift frame 42 vertically and a tilting air cylinder 47 inclines tiltable table 44. Table 44 includes a plurality of rotatable rollers 48.

Operation of the conveyance direction changing means 25 is as follows. To receive an article W which has slid down a slant rack 21, lift frame 42 is raised by lift air cylinder 46 to align table 44 with the lower end of slant rack 21 so that it assumes the loading stand-by position shown in broken outline in FIG. 6. In this position, actuating piece 45 permits article W to slide directly onto table 44 which is inclined like slant track 21.

Thereafter, the lift frame 42 descends until it abuts a stop 50 mounted on support post 40, and table 44 is at the same height as the next lower slant rack 22. In this position, the actuating piece 45 also moves downward with the lift frame 42, allowing stop 41 to tilt by virtue of its own weight and assume the position shown in solid outline in FIG. 6. This prevents the next article W which slides down slant rack 21 from falling off the lower end of slant rack 21.

The table 44, now at the same height as slant rack 22, is tilted, by the operation of air cylinder 47, to the position shown in solid outline in FIG. 6, in which it is in alignment with slant rack 22. Therefore, article W slides, by virtue of its own weight, backward from the table 44 and down slant rack 22, to be received by the next direction changing means 25.

Referring to FIGS. 7–10, each article delivery means 26 is provided with a delivery table 60, a delivery stop 61 and an air cylinder 62. The table 60 has a plurality of rotatable rollers 63 and is pivotally connected by pins 64 to a frame 65. Stop 61 has a delivery preventing piece 66 pivotally connected by delivery stop pins 67 to frame 65. Air cylinder 62 is connected, both to table 60 and to stop 61, through pins 68.

Operation of article delivery means 26 is as follows. Table 60 and stop 61 are maintained inclined by air cylinder 62 at approximately the same inclination as that of slant rack 22, as shown in solid outline in FIG. 7. In this position, piece 66 projects from the delivery table 60 and an article W, which has slid down slant rack 22, slides directly onto table 60 and is stopped by piece 66.

Thereafter, air cylinder 62 operates to push up the receiving ends of table 60 and stop 61 with the receiving end of table 60 projecting from the upper surface of slant rack 22. The distance between the pivotal axes of pins 68 and pins 67 is shorter than the distance between the pivotal axes of pins 68 and pins 64. Therefore, stop 61 inclines to a greater extent than table 60 causing piece 66 of stop 61 to retract into table 60. As a result, the article W is fed onto a conveyor 69 while the next article W which slides down slant rack 22 is blocked from sliding onto table 60 by the receiving end thereof.

Summarizing operation of the entire article storage rack apparatus 20, article loading means 24 introduces an article W onto the topmost slant rack 21 of a selected article storage area 27. The article W slides forwardly down slant rack 21 by virtue of its own weight to be received by conveyance direction changing means 25, where it transfers to the next lower slant rack 22 without changing its orientation. Consequently, the article W then slides backwardly down the next lower slant rack 22. The next conveyance direction changing means 25 receives the article W where it is again transferred to the next lower slant rack 21, and this time it slides down forwardly, maintaining its orientation.

Thus, the article W slides down slant racks 21 and 22, successively changing its traveling direction without changing its orientation, until received by the article delivery means 26 where it is stopped and stored. An article W subsequently introduced in opening 28 also slides down slant racks 21 and 22, in the same manner as described above, until it abuts the preceding article W, whereupon it stops and is stored.

Thus, articles W may be stored in each article storage area 27 and dispensed onto conveyor 69 by article delivery means 26 in a first-in, first-out order.

According to the invention, it is also possible, by operation of conveyance direction changing means 25, to prevent each article W from sliding down storage rack 23 and store it on an intermediate slant rack 21 or 22.

Some of the many advantages and novel features of the invention should now be readily apparent. For instance, by introducing articles into storage racks at a high position, they are conveyed and stored onto lower racks automatically, thereby effectively utilizing the racks and enhancing the article storage efficiency. The entire structure is greatly simplified by the elimination of the need for traveling dispenser for delivery of articles from each rack. Articles can now be dispensed any time from a low position, thus shortening the delivery time.

Various modifications can be made to the apparatus as described herein without departing from the scope of the invention as defined in the following claims.

We claim:

1. A first-in, first-out article storage rack apparatus including: an article storage rack comprising a first set of slant racks inclined downwardly in one direction, and a second set of slant racks inclined downwardly in the opposite direction, each slant rack having an upper end and a lower end, and the slant racks of said first and second sets being arranged alternately in a vertical column with the lower end of each slant rack, except for the lowermost slant rack, being vertically spaced from, and located above, the upper end of the next lower slant rack; article loading means for loading articles onto said slant racks; a plurality of conveyance direction changing means for transferring articles from the lower end of each slant rack except for the lowermost slant rack, to the upper end of the next lower slant rack, each of the conveyance direction changing means providing an article-receiving lift frame movable vertically from a position adjacent to the lower end of each slant rack, except for the lowermost slant rack, to a position adjacent to the upper end of the next lower slant rack, and tiltable stopper means for impeding the flow of articles from the lower end of each slant rack, except for the lowermost slant rack, when the last-mentioned lower end has no lift frame adjacent to it; and an article delivery means for delivery of the articles stored on the slant racks.

2. A first-in, first-out article storage rack apparatus according to claim 1 having tiltable, article-supporting, table means pivotally connected to each lift frame, each said tiltable table means being tiltable into alignment with a first slant rack from which said table means can receive an article, and into alignment with a next lower slant rack to which said table means can discharge an article.

3. A first-in, first-out article storage rack apparatus according to claim 2 wherein the tiltable table means is provided with roller means for supporting articles while allowing the articles to move across the tiltable table means.

4. A first-in, first-out article storage rack apparatus according to claim 1 having stopper actuator means, connected to the lift frame providing means, for temporarily disabling the article flow-impeding action of the tiltable stopper means.

* * * * *